United States Patent [19]

Daw

[11] Patent Number: 4,929,150

[45] Date of Patent: May 29, 1990

[54] APPARATUS FOR ADJUSTING FLOW RATE THROUGH A FAN

[75] Inventor: Terry L. Daw, Murray, Utah

[73] Assignee: Daw Technologies, Salt Lake City, Utah

[21] Appl. No.: 330,911

[22] Filed: Mar. 31, 1989

[51] Int. Cl.[5] ..... F01D 17/14

[52] U.S. Cl. ..... 415/157

[58] Field of Search ..... 415/157, 148

[56] References Cited

U.S. PATENT DOCUMENTS

| | | | |
|---|---|---|---|
| 1,467,901 | 9/1923 | Lange | 98/38.9 |
| 1,529,711 | 3/1925 | Parrott et al. | 98/33.1 |
| 1,834,959 | 12/1931 | May | 415/157 |
| 2,100,152 | 11/1937 | Youker | 98/31.5 |
| 2,430,225 | 11/1947 | Hagler | 415/157 |
| 2,542,121 | 2/1951 | Earl | 415/157 |
| 2,837,021 | 6/1958 | McLarty | 98/42.07 |
| 4,375,939 | 3/1983 | Mount et al. | 415/157 |
| 4,808,068 | 2/1989 | Asbjornson et al. | 415/157 |

FOREIGN PATENT DOCUMENTS

| | | | |
|---|---|---|---|
| 1262124 | 10/1986 | U.S.S.R. | 415/157 |
| 1194041 | 6/1970 | United Kingdom | 415/157 |

*Primary Examiner*—Robert E. Garrett
*Assistant Examiner*—John T. Kwon
*Attorney, Agent, or Firm*—Thorpe, North & Western

[57] ABSTRACT

The present invention relates to a flow rate adjustment device which allows for adjustment of air flow through the fan without changing the rpms of the fan blades. In one embodiment, an adjustable plate is located in the center of the impeller and is movable in such a manner that various lengths of the blade edges are blocked from the intake air at the center of the impeller. In another embodiment of the invention, the plate is replaced by an inflatable blocking device which can be inflated to various degrees thereby blocking various lengths of the blade edges. In both embodiments, the blocking of the blade edges results in less intake air being exposed to the blades, and thus less air moves through the fan even though the rpms remain constant.

14 Claims, 5 Drawing Sheets

APPARATUS FOR ADJUSTING FLOW RATE THROUGH A FAN

BACKGROUND OF THE INVENTION

1. Field of the Invention

The invention relates to an apparatus which allows adjustment of the air flow rate through a fan without adjusting the rpm of the fan blades. More specifically, the invention relates to an apparatus which adjusts the amount of fan blade which can effectively move air through the fan.

2. Brief Description of the Prior Art

Prior to the present invention, when it was required to regulate the flow of air through a fan, the common mode of regulation was to adjust the rpm of the fan blades. This was accomplished by changing the speed of the drive motor, or by using a transmission system which allowed the motor speed to remain relatively constant while changing the speed of the drive shaft. Both prior art methods of air flow adjustment required extensive modifications and/or additional machinery attached to the drive motor.

Others have attempted to solve the problem of adjusting the air flow rate through a fan without resorting to a change in rpm of the fan blades but have not had much success. Generally, the prior art approach has been to move the fan blades or the entire fan in some cases ( i.e., blades, shaft, and even the drive motor), into and out of operating relationship with an air exit vent. For example, Youker, U.S. Pat. No. 2,100,152, discloses a vent fan mounted on guide rods and movable thereon along a horizontal axis to adjust the location of the fan blades in the vent path, and also the size of the exit vent itself. McLarty, U.S. Pat. No. 2,837,021, also shows a fan mounted on a rod for horizontal movement in and out of an air vent. Lange, U.S. Pat. No. 1,467,901, and Parrott et al., U.S. Pat. No. 1,529,711, disclose ventilator fan arrangements which include fan blades which are adjustable along the length of their axis. In each of the above cases, the apparatus required to move the fan in relation to the exit vent, is complicated and extensive. Also there is no adaptability of the prior art devices for use with very large or heavy fans. As can be seen in the prior art devices, moving the entire fan in and out of an exit vent becomes very impractical with fans of large size or significant weight.

SUMMARY OF THE INVENTION

An object of the present invention is to provide an apparatus which can adjust the rate of air flow through a fan without changing the rpm of the fan blades.

A further object of the present invention is to provide an apparatus which adjusts the air flow rate through a fan without changing the rpm of the fan and without movement of the fan or portions thereof with respect to an exit vent.

A further object of the present invention is to provide an apparatus which can adjust the rate of air flow through a fan by adjusting the amount of the fan blade surface which is effective in moving air through the fan.

A further object of the present invention is to change the air flow delivery rate of a fan through the use of an adjustable plate inserted in the center of the fan impeller, which is translatable along the fan's drive shaft, and which blocks a portion of the fan blades from exposure to the air in the air intake opening of the fan.

A further object of the present invention is to change the air flow delivery rate of a fan through the use of an adjustable plate inserted in the center of the fan impeller at the intake opening, which plate is adjustable to block a portion of the blade surfaces from exposure to the air intake opening, thereby changing the air flow rate through the fan.

Another object of the present invention is to change the air flow rate through a fan through the use of an inflatable member attached to the base of the center of the impeller and to the adjustable plate, which is inflatable to translate the adjustable plate to vary its location in the intake opening and thereby adjust the portion of the fan blades which have access to the air in the intake opening.

These and other objects are realized in a fan air flow adjustment plate which is located in the central air intake opening of a conventional fan impeller.

The impeller of a conventional fan comprises a circular impeller base plate, a toroidal impeller top plate, and a plurality of blades spaced in a generally circular configuration therebetween. The blades have interior edges which meet the inner circular opening of the toroidal impeller top plate thus creating the central air intake opening. The blades further have exterior edges which meet the exterior circumferential edges of both the impeller base and top plates thus creating air flow channels extending from the interior edges of the blades and the circular opening in the toroidally shaped top plate, to the exterior edges of the blades and the top and bottom plates. Each channel being defined by a pair of blade surfaces and the top and bottom plates.

The adjustable plate has a circular diameter slightly smaller than the circular air intake opening such that it can translate therein, yet still substantially block the interior edges of the blades from exposure to air coming in the opening. Blocking the interior edges of the blades with the adjustable plate substantially reduces the amount of air which can be moved by the blade surfaces. The portions of the blades which have been blocked from the air intake opening become ineffective in moving air through the fan. Thus, without changing the rpm of the blades, the air flow through the fan can be changed. The plate can be translated in the air intake openings either by means of a pressurizable chamber between the adjustable plate and the impeller base plate, or by means of an adjustment shaft connected to the center of the adjustment plate and extending out of the air intake opening. When the plate is translated in the opening, the rate of air flow is affected. The air flow rate corresponding to particular locations of the plate in the opening, can be incorporated into the adjustment mechanism such that air flow rate can be set directly with the adjustment mechanism.

Other objects and features of the present invention will be apparent to those skilled in the art in view of the following detailed description, taken in combination with the accompanying drawings.

BRIEF DESCRIPTION OF THE DRAWINGS

FIG. 2 also shows in phantom the translation of the adjustment plate, and the effected blade portions no longer exposed to air in the intake openings.

DETAILED DESCRIPTION OF THE INVENTION

Figure 1:
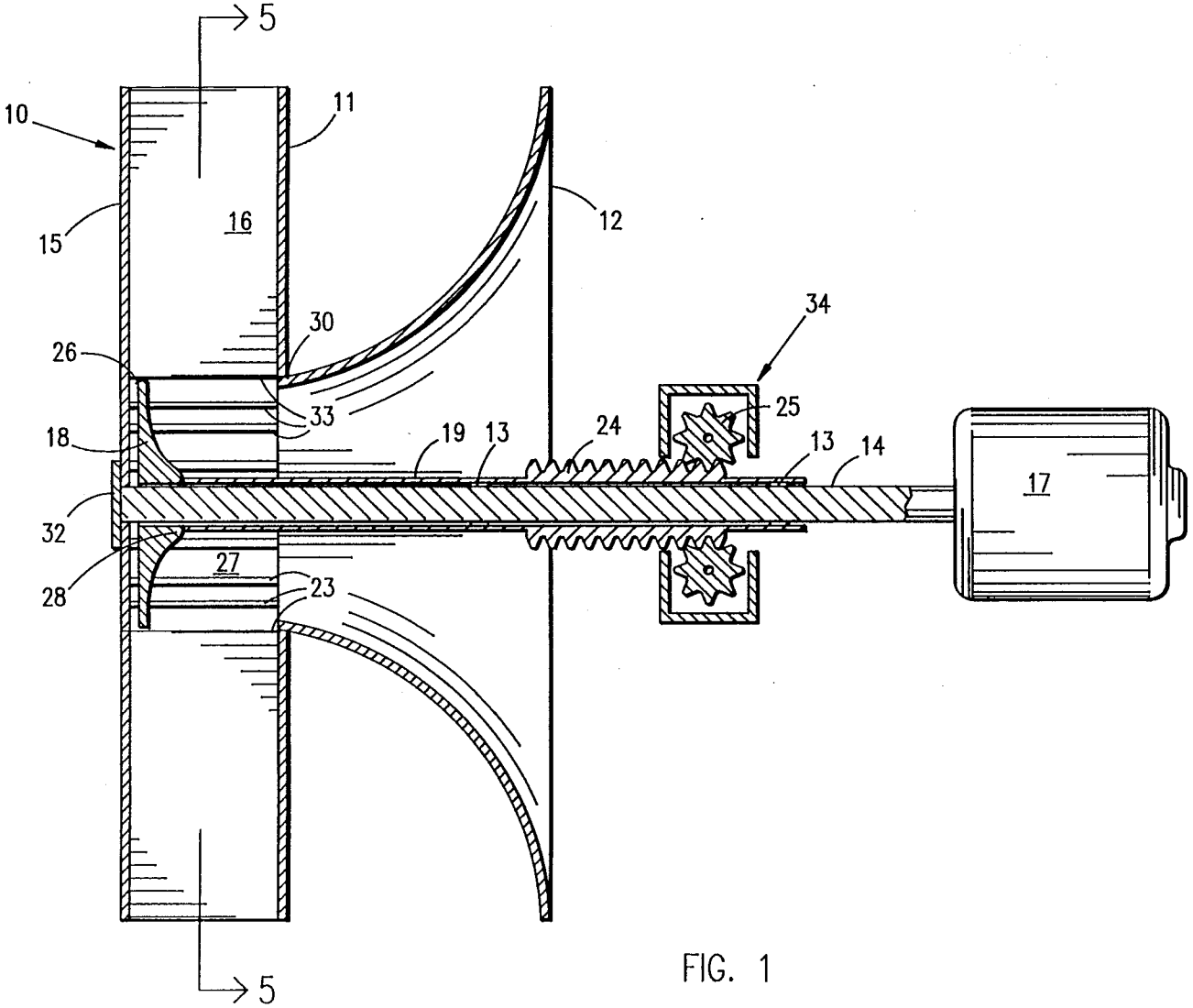
FIG. 1 is a partially cut away cross-sectional view of the present air flow rate adjustment device in conjunction with a conventional fan, where the adjustment shaft surrounds the fan drive shaft.
Figure 3:
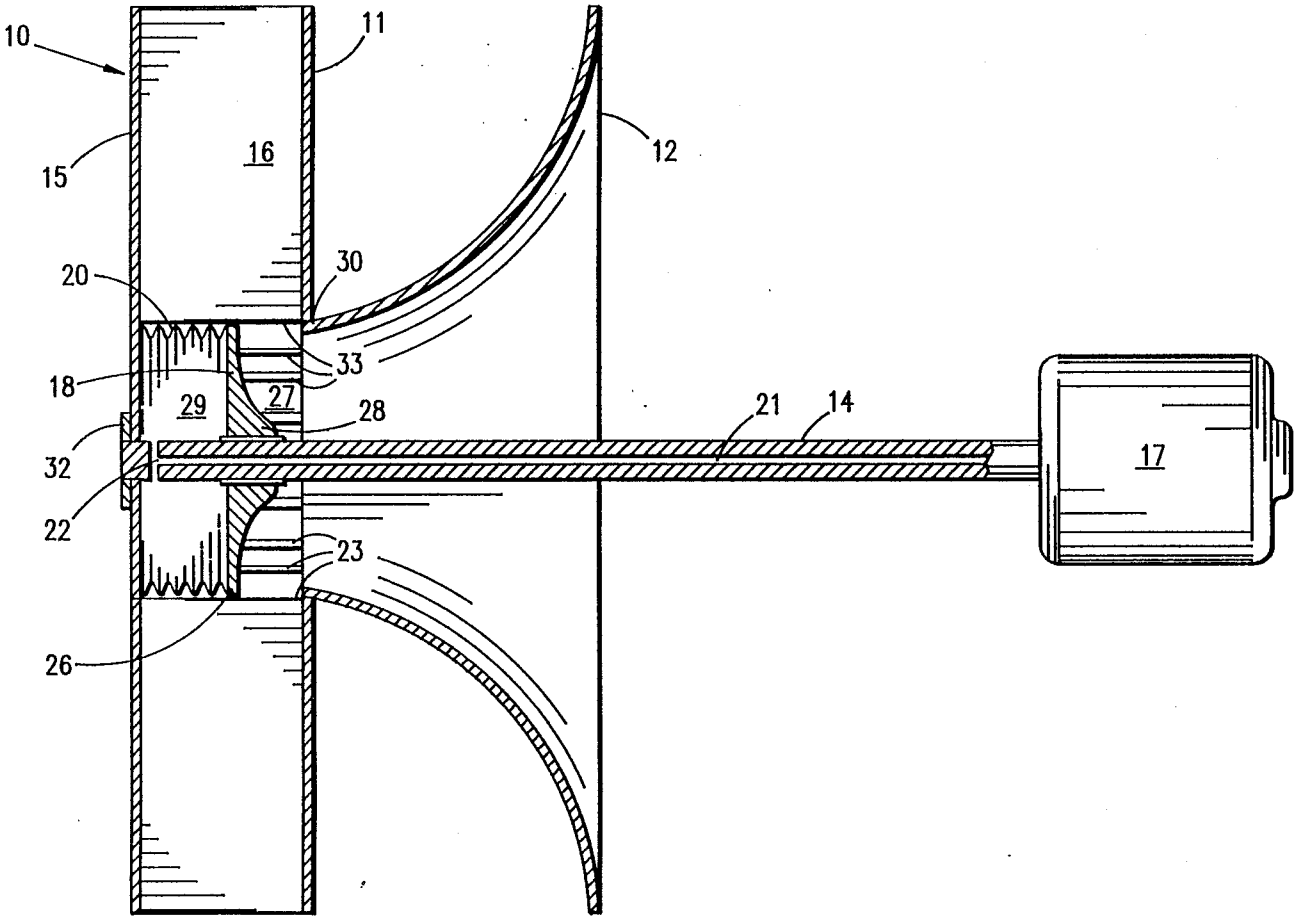
FIG. 3 is a partially cut away cross-sectional view of another embodiment of the present invention wherein the adjustment plate is translated in the air intake opening by means of a pressurizable chamber.
Figure 5:
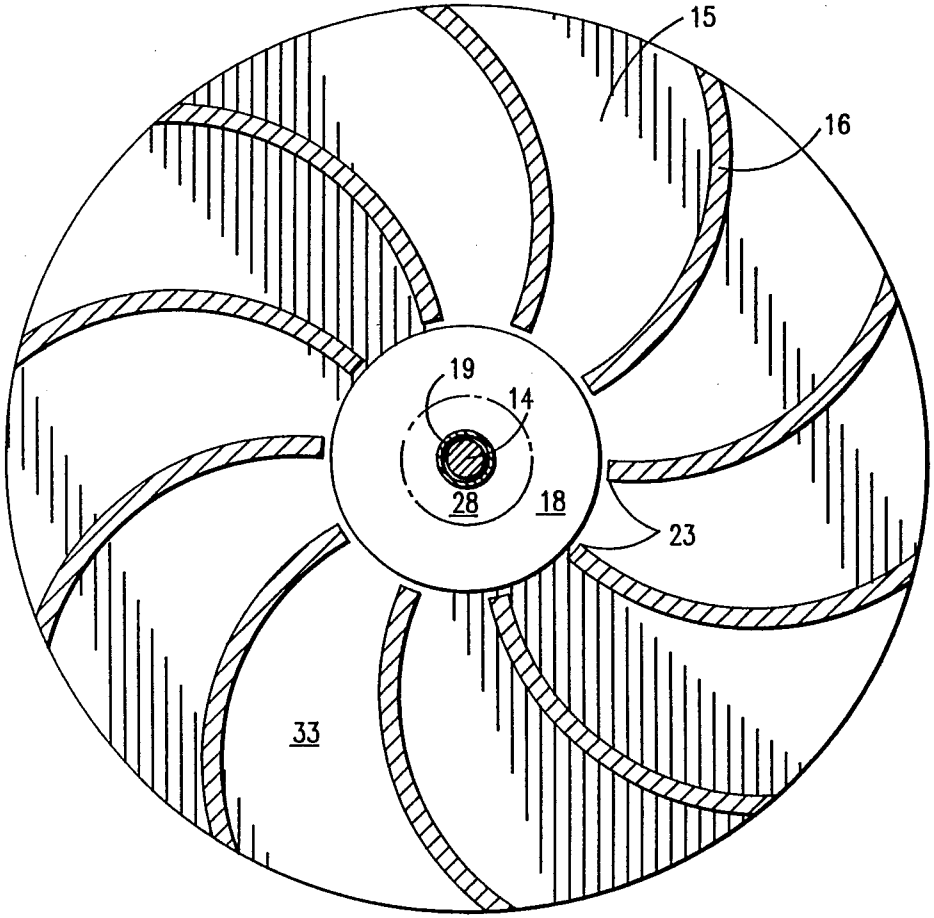
FIG. 5 is a cross-sectional view of FIG. 1 taken at line 4—4 of FIG. 1.

FIG. 1 shows a cross-sectional view of a fan in conjunction with the first embodiment of the present invention. The fan itself is made up of an impeller 10, a shaft 14, a motor 17, and intake cone 12. The impeller 10 comprises a circular impeller base plate 15, a toroidal impeller top plate 11, and blades 16. The blades 16 are located in a circular configuration around the base plate 15 in a manner best seen in FIG. 5. The top plate 11 is attached to the blades 16 on the side opposite the base plate 15 such that the interior edge 30 of its circular opening is adjacent to the interior edges 23 of the blades 16. Each blade 16 being equally spaced from the other blades such that the top and bottom plates of the impeller create a plurality of air flow channels 33 extending the length of the blades 16. Thus air is allowed to flow through the intake cone 12, into the air intake opening 27 and to be drawn into channels 33 by the rotating interior edges 23 of the blades 16. A drive shaft 14 is connected to the center of impeller base plate 15 in such a manner that rotation of the drive shaft 14 causes equivalent rotation of the impeller 10 and blades 16. The drive shaft 14 can be connected to the impeller base plate 15 such that it extends through the center of the air intake opening 27, as shown in FIGS. 1 and 3, or such that it extends away from the impeller 10 in a direction directly opposite the air intake opening 27. The shaft 14 may be attached to the impeller base plate 15 in any conventional manner such as by a flange 32 and bolts (not shown), and either with the shaft passing through the impeller base plate 15 or merely abutting thereon. Motor 17 is operably attached to the opposite end of the drive shaft 14 such that it can operate to rotate the shaft 14 and impeller 10.

Figure 2:
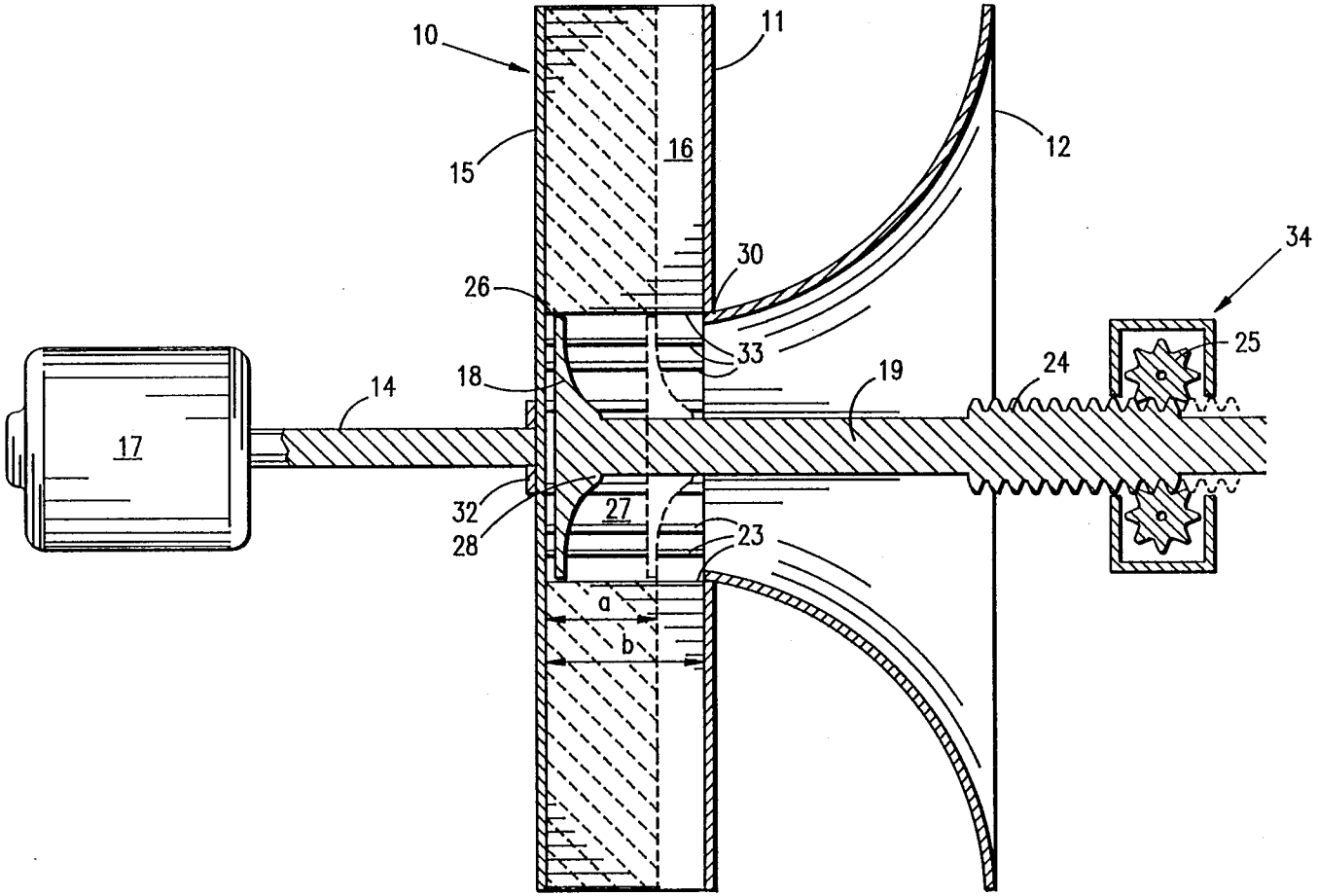
FIG. 2 is a partially cut away cross-sectional view of the device of FIG. 1 where the drive shaft is located on the side of the impeller base plate opposite the air intake opening.

The flow adjustment apparatus of the present invention as shown in FIGS. 1 and 2 comprises a flow adjustment plate 18, an adjustment shaft 19 and an adjustment mechanism 34. The flow adjustment plate 18 is slidably attached to the drive shaft 14 with adjustment shaft 19 fixedly attached or integrally formed therewith. The adjustment plate 18 and shaft 19 are translatable along the drive shaft 14 by the adjustment mechanism 34. In the illustrated embodiment of the adjustment mechanism 34, rack 24 is fixedly attached to, or integrally formed with, the adjustment shaft 19 such that rotation of pinion 25 causes translation of rack 24, and thus translation of adjustment shaft 19. Although rack 24 and pinion 25 are shown to be the means for adjusting the location of adjustment shaft 19 along the drive shaft 14, it is to be understood that any conventional means such as a worm gear, cam, pinioned lever, etc., useful to cause a controlled movement of the adjustment shaft 19, may be employed in their place.

Adjustment plate 18 is sized such that it completely blocks the air intake opening 27 from the impeller base plate 15. The outer circumferential edge 26 of the adjustment plate 18 is, therefore, directly adjacent the interior edges 23 of the fan blades 16. It is important that the edge 26 of plate 18 be located as close to the blade edges 23 as possible without actually coming in contact therewith. This is required so that portions of the edges 23 of the blades 16 which are below the plate 18 (in the area between adjustment plate 18 and impeller plate 15) have no possibility of exposure to air entering the intake opening 27.

The adjustment shaft 19 is mounted on the drive shaft by means of bearings 13. The bearings 13 allow the adjustment shaft 19 and plate 18 to remain stationary in the rotational direction, yet movable in the translational direction while the drive shaft 14 is rotating.

As shown in FIG. 2, it is anticipated that the adjustment device of the present invention will also be used with fans which have the drive shaft 14 located on the side of the impeller base plate 15 which is opposite the air intake opening 27. In this embodiment, the adjustment shaft 19 need no longer accommodate the drive shaft 14 and may therefore be made solid instead of hollow if desired. The entire adjustment assembly including adjustment plate 18, adjustment shaft 19 and adjustment mechanism 34 will therefore be supported separately from the motor 17 and drive shaft 14. The adjustment device as embodied in FIG. 2 may be supported by any conventional support means (not shown) which will allow translation of the adjustment shaft 19 and plate 18 in the air intake opening 27 of the fan impeller 10.

In the embodiments of either FIG. 1 or 2, when it is desired to adjust the air flow through the fan, the pinion 25 is rotated in rack 24 to cause translation of the adjustment shaft 19 and flow adjustment plate 18 in the air intake opening 27. The phantom lines of FIG. 2 show the flow adjustment plate 18, moved by the rack 24 and pinion 25, to a point in the air intake opening 27 such that a length "a" of the blade interior edges 23 is blocked from air entering the intake opening 27. Since the portion "a" of the blade interior edges 23 is blocked from the air intake opening 27, air entering the fan can only be taken into the blades 16 by the shortened length of the blade interior edges 23 which are still exposed to air flow. When the plate 18 is located thus, the shaded area of the blades 16 no longer remain effective for moving air through the fan. Since the air entering the intake opening 27 is denied access to a portion of the blade interior edges 23, the amount of flow through the fan is substantially inhibited. Thus a change in length "a" is accompanied by a change in the rate of air flow through the fan even though the rpm of the blades 16 remain constant.

As can be readily seen, one of ordinary skill in the art can determine the flow rate of air through the fan for any length "a", and thus allow for direct flow rate adjustment by proper calibration of the rack 24 and pinion 25. For example, placement of rack 24 in a predetermined relation to pinion 25 can relate directly to a predetermined flow rate through the fan. As has been indicated above, however, the rack 24 and pinion 25 are intended to be only an illustrative means of adjusting the flow adjustment plate 18. Any other of the above indicated well-known adjustment mechanisms may be used to allow a direct adjustment of air flow rate by its translation of the adjustment shaft 19.

FIG. 3 is a cross-sectional view of another embodiment of the invention. In this embodiment, the flow adjustment plate 18 is connected to the impeller base plate by means of an airtight flexible wall 20. The flow adjustment plate 18, impeller base plate 15, and flexible wall 20 create a fluid tight chamber 29. Pressurized fluid is added to, or removed from, the fluid chamber 29 through passage 21 located in the drive shaft 14. Passage 21 opens into the chamber 29 as shown at 22 or in any like manner and a source of pressurized fluid (not shown) is attached to the opposite end of passage 21 in a manner such that it can be operated to control the pressure in chamber 29. Flow adjustment plate 18 is slidingly yet sealingly attached to the drive shaft 14 by means of a sealing ring 31 which is made of any well-known low friction and/or self lubricating material such as tetrafloroethelene or the like. When it is desired to move the plate 18 in the opening 27, pressurized fluid is added to or removed from chamber 29 through passage 21. As stated before in regard to the embodiments of FIGS. 1 and 2, the pressure in chamber 29 can be made to directly correspond to air flow rates through the fan.

Figure 4:
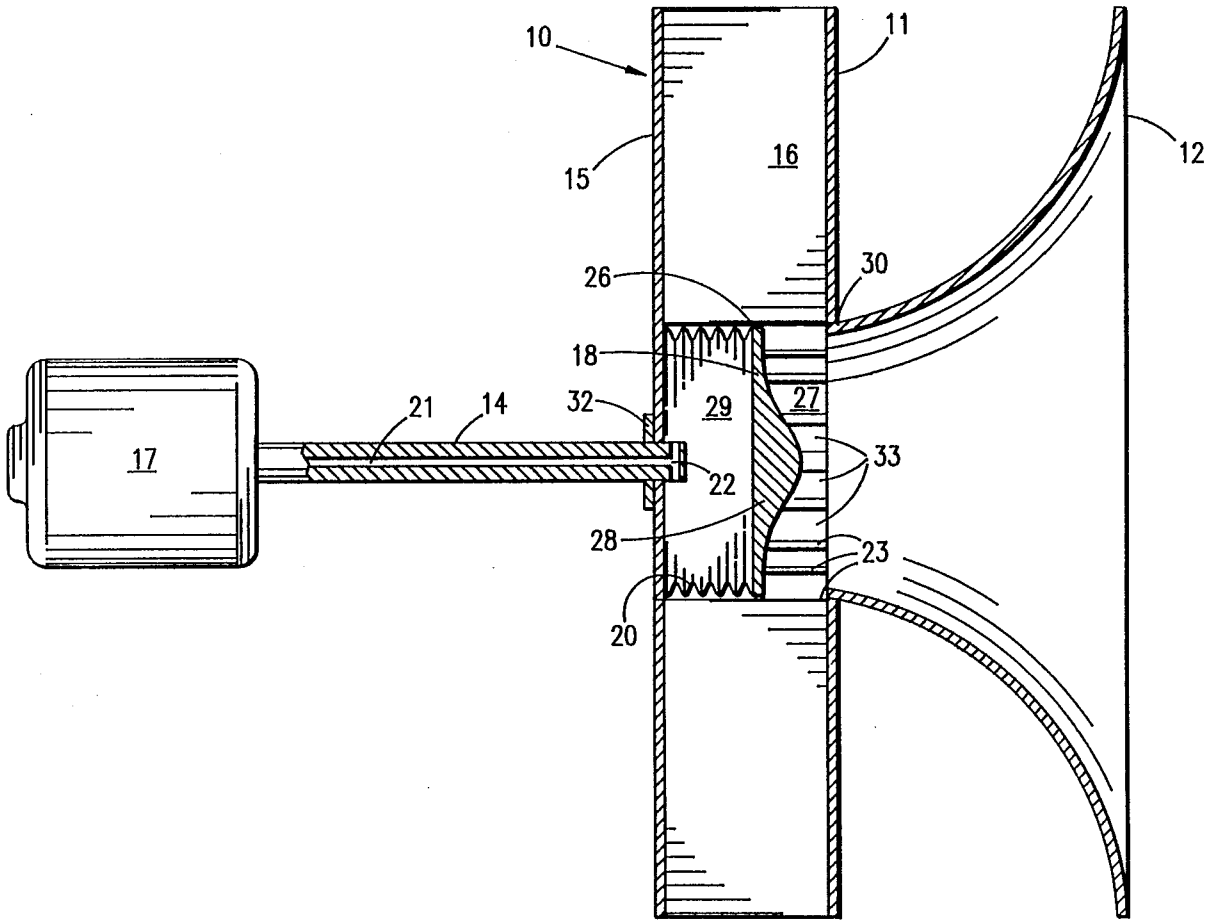
FIG. 4 is a partially cut away view of the device of FIG. 3 which shows the drive shaft located on the side of the impeller base plate opposite the air intake opening.

In the emdodiment of FIG. 4, the drive shaft 14 and motor 17 are placed on the side of the impeller base plate opposite the air intake opening substantially in the same manner as described in FIG. 2. The flow adjustment plate need not seal to the drive shaft in this embodiment as is required in the embodiment of FIG. 3, however, since the shaft 14 is now located on the opposite side of the imeller 10. In all other respects, this embodiment is substantially the same as that of FIG. 3.

When it is desired to adjust the air flow rate of the fan in the embodiments of FIG. 3 or 4, the fluid chamber 29 is inflated or deflated to cause the flow adjustment plate 18 to move to the desired location in the air intake opening 27. The fluid chamber 29 completely fills the space between the impeller base plate 15 and the flow adjustment plate 18.

This type of plate adjustment mechanism helps avoid energy loss which could be caused by the creation of a vacuum in the area below the adjustment plate 18. This vacuum would have been created in this area by the rotating portions of the blades 16 which are below plate 18 and have no air source to drawn on. Since chamber 29 completely fills this area, there is no space for the vacuum to draw on.

As shown in FIGS. 1–4, the flow adjustment plate 18 may also include a conical section 28 which is shaped such that it prevents turbulence and allows an efficient, substantially laminar intake flow of air to the blades 16.

It is to be understood that the above-described emodiments are only illustrative of the application of the principles of the present invention. Numerous modifications and embodiments may be devised by those skilled in the art without departing from the spirit and scope of the present invention. The appended claims are intended to cover such modifications and embodiments.

What I claim is:

1. A fluid transport system comprising:

an inlet opening, a flow channel extending from the inlet opening to carry fluid in a controlled path through the drive system, a fan chamber coupled in line with the flow channel and having a chamber opening communicating with the flow channel, a fan member mounted within the fan chamber and including fan blades rotationally mounted to a base plate, said fan blades drawing fluid through the fan chamber upon rotation of the fan member to develop fluid flow through the channel and fan chamber, means for adjusting an amount of fan blade exposure to the flow channel during rotation to provide variable adjustment to the rate of fluid flow through the transport drive system without the need for varying the rate of fan rotation, said adjustment means including a plate means located in said fan chamber, and means attached to said base plate and to said plate means forming an adjustment chamber between said base plate and said plate means, whereby the flow rate through the fan changes as the location of the plate means in the fan chamber changes, said plate means being movable in the fan chamber in response to fluid changes in said adjustment chamber.

2. A flow-regulating means of claim 1 wherein said means for adjusting an amount of fan blade exposure changes the rate of air flow through the fan while the rate of rotation of the blades remains constant.

3. A flow-regulating means of claim 2 wherein said plate means is cylindrically shaped and sized to fit within the fan chamber such that a circumferential edge of said plate means extends to, yet does not contact with, the interior edges of the fan blades.

4. A flow-regulating means of claim 3 wherein said plate means further includes a conical central portion whereby air is effectively moved from the air intake opening toward the blades.

5. A flow-regulating means of claim 2 wherein said adjustment means comprises an adjustment shaft connected to the center of said plate means and which extends out of the fan chamber opening.

6. A flow-regulating means of claim 5 wherein said adjustment shaft is hollow and said adjustment means further includes bearing means whereby said adjustment shaft slidably and rotatably surrounds the drive shaft and said bearing means are located between said adjustment shaft and the drive shaft.

7. A flow-regulating means of claims 6 wherein said adjustment means further comprises a rack and pinion means operably associated with said adjustment shaft whereby rotation of said pinion means causes said rack means to raise or lower said plate means in said air intake opening thereby adjusting the length of the blade edges exposed to the air in the center of the impeller.

8. A flow-regulating means of claim 1 further including a means for supplying a pressure fluid to said adjustment chamber.

9. A flow-regulating means of claim 1 further including a drive shaft having a first end thereof said base plate at the center thereof, and said means for supplying a pressurized fluid comprises a passage in said drive shaft.

10. A flow-regulating means of claim 9 wherein a second end of the drive shaft is attached to the motor.

11. A flow-regulating means of claim 9 wherein said plate means defines an opening through its center and the drive shaft extends through said opening in the center of said plate means and wherein said plate means further comprises a fluid-tight slidable sealing means which slidably connects the drive shaft and said plate means,

12. A flow-regulating means of claim 9 wherein said passage for pressurized fluid extends into the said chamber at one end and to a pressurized fluid source at its other end.

13. A flow-regulating means of claim 12 wherein an adjustment shaft is solid and the drive shaft extends from the side of the base plate opposite the air intake opening.

14. A flow-regulating means of claim 1 wherein said plate means further includes a conical central portion whereby air is efficiently moved from the air intake opening toward the blades.

* * * * *